US005261802A

United States Patent [19]

Yanagisawa

[11] Patent Number: 5,261,802

[45] Date of Patent: Nov. 16, 1993

[54] SCREW VACUUM PUMP

[75] Inventor: Kiyoshi Yanagisawa, Kanagawa, Japan

[73] Assignee: Ebara Corporation, Tokyo, Japan

[21] Appl. No.: 942,031

[22] Filed: Sep. 8, 1992

[30] Foreign Application Priority Data

Sep. 27, 1991 [JP] Japan ..... 3-276886

[51] Int. Cl.[5] ..... F01C 1/16

[52] U.S. Cl. ..... 418/201.2; 418/9; 417/295

[58] Field of Search ..... 418/201.1, 201.2, 9; 417/295

[56] References Cited

U.S. PATENT DOCUMENTS

| | | | |
|---|---|---|---|
| 3,977,818 | 8/1976 | Sprankle | 418/201.2 |
| 4,968,221 | 11/1990 | Noll | 417/295 |
| 5,051,077 | 9/1991 | Yanagisawa et al. | 418/201.1 |

FOREIGN PATENT DOCUMENTS

| | | |
|---|---|---|
| 0059834 | 9/1982 | European Pat. Off. . |
| 3618301 | 12/1986 | Fed. Rep. of Germany . |
| 2601083 | 1/1988 | France . |
| 61-31687 | 2/1986 | Japan . |
| 62-284994 | 12/1987 | Japan . |
| 2-199287 | 8/1990 | Japan . |

OTHER PUBLICATIONS

Patent Abstracts of Japan, vol. 7, No. 291, (M-265)(1436), Dec. 27, 1983, JP-A-58162788, Sep. 27, 1983, T. Maruyama, "Compressor".

Patent Abstracts of Japan, vol. 7, No. 187, (M-236)(1332), Aug. 16, 1983, JP-A-5888487, May 26, 1983, I. Kawabe, et al., "Rotary Compressor".

Patent Abstracts of Japan, vol. 9, No. 34, (M-357)(1757), Feb. 14, 1985, JP-A-59176490, Oct. 5, 1984, S. Suzuki et al., "Screw Compressor".

*Primary Examiner*—Richard A. Bertsch
*Assistant Examiner*—Charles Freay
*Attorney, Agent, or Firm*—Oblon, Spivak, McClelland, Maier & Neustadt

[57] ABSTRACT

A screw vacuum pump is capable of reducing the load thereon at the time of evacuation of a gas at atmospheric pressure by the use of a throttle plate. The screw vacuum pump has male and female rotors which rotate in meshing engagement with each other around two parallel axes, respectively, in a casing so that a gas that is sucked in from a suction opening is introduced through a suction port into a groove space defined between the male and female rotors and the casing is then discharged from a discharge opening through a discharge port, wherein the throttle plate is provided upstream of and near the opening of the suction port.

5 Claims, 4 Drawing Sheets

SCREW VACUUM PUMP

BACKGROUND OF THE INVENTION

1. Field of the Invention

The present invention relates to a screw vacuum pump and, more particularly, to a screw vacuum pump which is designed so that it is possible to reduce the load on the pump at the time of evacuation of a gas at atmospheric pressure.

2. Discussion of the Background

The following are conventional methods of reducing the load at the time of evacuation of a gas at atmospheric pressure in a screw vacuum pump which has a pair of male and female rotors rotating in mesh with each other around two parallel axes, respectively, in a casing:

(1) A method wherein the rotating speed of the screw vacuum pump is lowered at the time of evacuation of a gas under atmospheric pressure, thereby reducing the load on the pump.

(2) A method wherein a valve is provided at the suction side of the screw vacuum pump and the valve is throttled to reduce the load on the pump at the time of evacuation of a gas of atmospheric pressure.

(3) A method wherein the screw vacuum pump is arranged in a two-stage structure comprising a pre-stage pump and a post-stage pump and only the post-stage pump is operated at the time of evacuation of a gas at atmospheric pressure.

The above-described methods (1) to (3) of reducing the load on the pump at the time of evacuation of a gas at of atmospheric pressure suffer from the following disadvantages:

The load reducing method (1) needs an inverter or the like to change the rotating speed of the pump.

The load reducing method (2) necessitates providing a valve at the suction side and also needs a controller for controlling the throttling of the valve.

The load reducing method (3) shortens the lifetime of the machine because the pre-stage pump repeats starting and stopping at the time of evacuation of a gas of atmospheric pressure.

SUMMARY OF THE INVENTION

In view of the above-described circumstances, it is an object of the present invention to provide a screw vacuum pump capable of reducing the load on the pump at the time of evacuation of a gas of atmospheric pressure with a simple structure.

To solve the above-described problems, the present invention provides a screw vacuum pump which has male and female rotors rotating in mesh with each other around two parallel axes, respectively, in a casing so that a gas that is sucked in from a suction opening is introduced through a suction port into a groove space defined between the male and female rotors and the casing and then discharged from a discharge opening through a discharge port, wherein a throttle plate is provided upstream and near the opening of the suction port.

By virtue of the above-described arrangement that a throttle plate is provided upstream and near the opening of the suction port, even if a gas at atmospheric pressure flows at the time of evacuation, the throttle plate causes a pressure drop, and the fluid is sucked into the groove space before the pressure recovers. As a result, the suction pressure and volume flow rate of the pump decrease, resulting in a reduction in the load.

BRIEF DESCRIPTION OF THE DRAWINGS:

Various other objects, features and attendant advantages of the present invention will be more fully appreciated as the same becomes better understood from the following detailed description when considered in connection with the accompanying drawings in which like reference characters designate like or corresponding parts throughout the several views and wherein.

Figure 1:
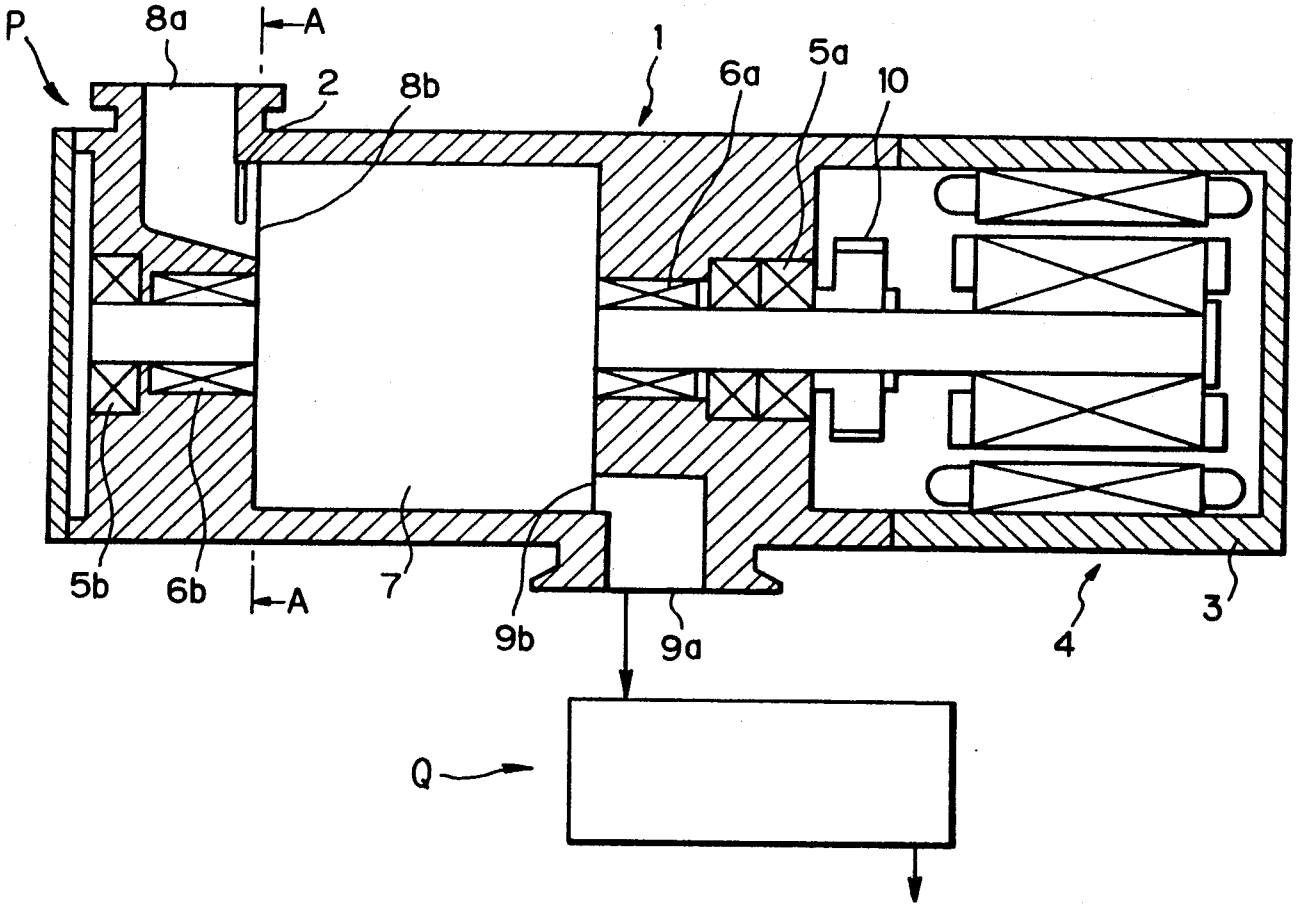
FIG. 1 is a sectional side view showing the structure of the screw vacuum pump according to the present invention.

DESCRIPTION OF THE PREFERRED EMBODIMENT:

One preferred embodiment of the present invention will now be described below with reference to the accompanying drawings. FIG. 1 is a sectional side view showing the structure of the screw vacuum pump according to the present invention.

The screw vacuum pump has a casing 1 and a pair of male and female rotors 7, which are rotatably supported by respective bearings 5*a* and 5*b* in a space defined inside the casing 1. The male and female rotors 7 are sealed off from lubricating oil used for the bearings 5*a* and 5*b* by respective shaft seals 6*a* and 6*b*. The shaft of one rotor, for example, the male rotor 7, is connected to a shaft of a motor 4. In addition, a timing gear 10 is provided on the male rotor 7 so that the male rotor 7 and the female rotor (not shown) are rotated through the timing gear 10 with a small clearance between the two rotors 7. Reference numeral 3 denotes a motor casing.

A gas that is sucked from a suction opening 8*a* is introduced through a suction port 8*b* into a groove space that is defined by the casing 1 and the two rotors 7 and then discharged from a discharge opening 9*a* through a discharge port 9*b*. A throttle plate 2 is provided upstream and near the opening of the suction port 8*b*.

Figure 2:
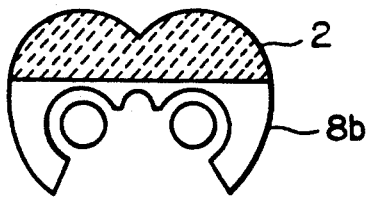
FIG. 2 is a view taken along line A—A in FIG. 1 and showing the configuration of a throttle plate.
Figure 3:
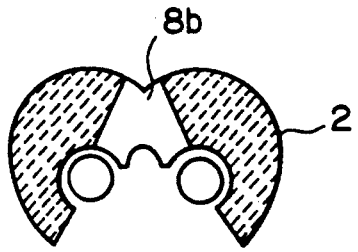
FIG. 3 is a view taken along A—A in FIG. 1 and showing the configuration of a throttle plate.
Figure 4:
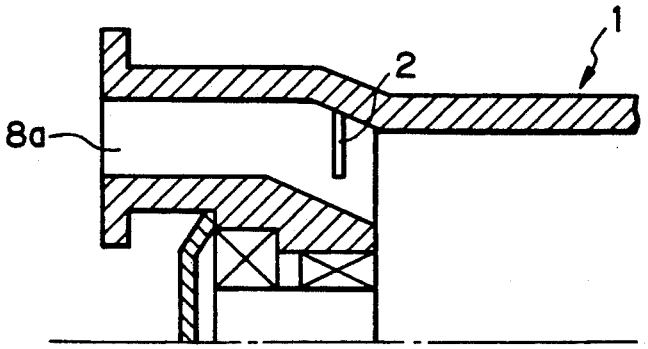
FIG. 4 is a sectional side view showing another example of the arrangement of a suction port and its surroundings in the screw vacuum pump according to the present invention.
Figure 5:
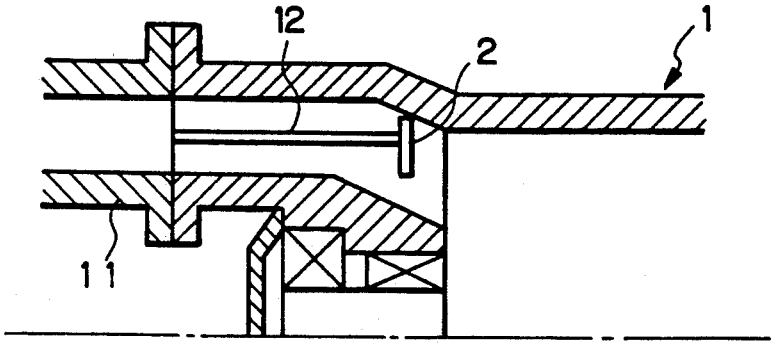
FIG. 5 shows an example of a throttle plate which extends from a suction connecting pipe.

FIGS. 2 and 3 are views seen from the arrow A—A in FIG. 1, each showing the configuration of the throttle plate 2. As illustrated, the throttle plate 2 is provided in such a manner as to close the opening of the suction port 8*b*. The throttle plate 2 may be formed by projecting a part of the casing 1. Alternatively, the throttle plate 2 may be formed as a member separate from the casing 1 and attached to it when the pump is assembled. The throttle plate 2 can be formed in the same way even in the case of a pump structure having a suction opening 8*a* which extends in the axial direction, as shown in FIG. 4. Further, the restrictor, that is, the throttle plate 2 may extend from a suction connecting pipe 11, as shown in FIG. 5. In this case, the restrictor throttle plate 2 is united with the suction connecting pipe 11 by a throttle plate support 12.

Figure 8:
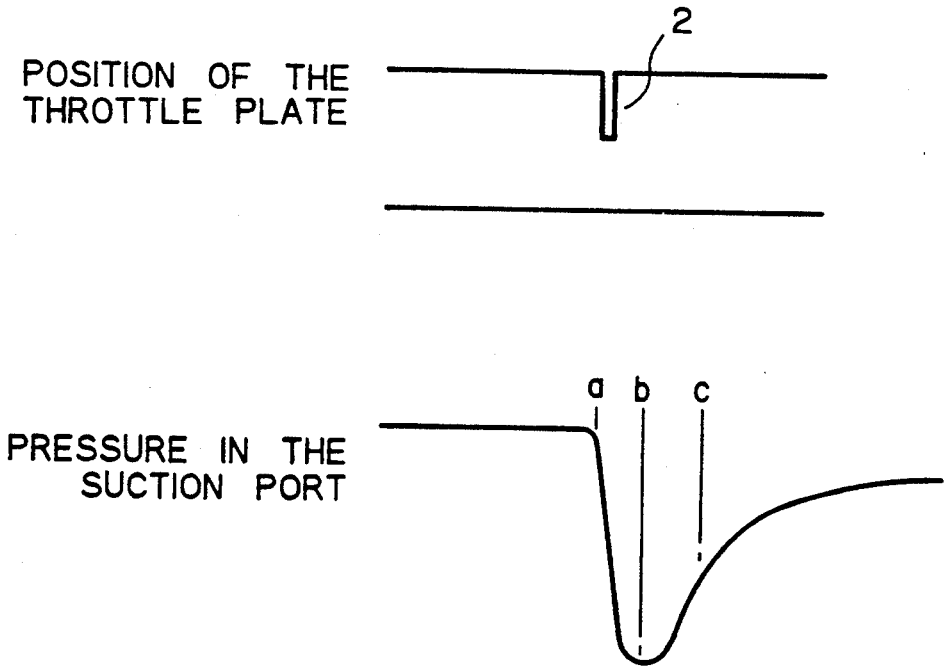
FIG. 8 is a diagram showing the position of the throttle plate and the change of the pressure in the suction port.

In the screw vacuum pump having the above-described structure wherein the throttle plate 2 is provided upstream and near the opening of the suction port 8*b*, even if a gas at atmospheric pressure flows at the time of evacuation, the throttle plate 2 causes a pressure drop, and since the throttle plate 2 is provided near the opening of the suction port 8*b*, the gas is sucked into the groove space before the pressure recovers. As a result, the suction pressure and volume flow rate at the pump decrease, so that the load on the pump can be reduced, as shown in FIG. 8. Referring to FIG. 8, when a gas of atmospheric pressure flows in, a pressure drop occurs at the downstream side of a position a of the throttle plate 2, and the pressure gradually recovers as the distance from the throttle plate 2 increases downstream. The suction port 8*b* is disposed at positions b to c shown in the figure.

In the case of a screw vacuum pump having a two-stage structure comprising a pre-stage pump as shown in FIG. 1 in which a two-stage structure including a pre-stage pump P and a post-stage pump Q are also schematically shown, and a post-stage pump, if the upstream (pre-stage) pump is arranged in the above-described structure that has the throttle plate 2, the discharge pressure thereof is also low at the time of evacuation of a gas of at atmospheric pressure by virtue of the throttling effect. Accordingly, the suction pressure of the downstream (post-stage) pump is low and the flow rate is also small. Therefore, the load on the downstream pump can also be reduced.

Figure 6:
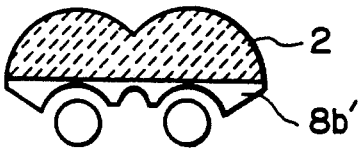
FIG. 6 is a view taken along line A—A in FIG. 1 and showing another example of the configuration of the throttle plate.
Figure 7:
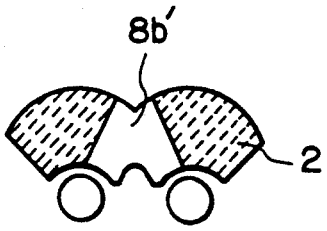
FIG. 7 is a view seen from the arrow A—A in FIG. 1 and showing another example of the configuration of the throttle plate.

The same advantageous effects are also obtained in pumps wherein the suction port 8*b'* is configured so as to trap a sucked gas before the groove space defined between the rotors and the casing reaches a maximum (see JP, A, 4-159488), as shown in FIGS. 6 and 7.

Thus, according to the present invention, a throttle plate is provided upstream and near the opening of the suction port. Therefore, even if a gas at atmospheric pressure flows at the time of evacuation, the throttle plate causes a pressure drop, and the gas is sucked into the groove space before the pressure recovers. As a result, the suction pressure and volume flow rate of the pump decrease. It is therefore possible to provide a screw vacuum pump capable of reducing the load thereon at the time of evacuation of a gas of atmospheric pressure with a simple structure.

Obviously, numerous modifications and variations of the present invention are possible in light of the above teachings. It is therefore to be understood that within the scope of the appended claims, the invention may be practiced otherwise than as specifically described herein.

What is claimed is:

1. A screw vacuum pump, which comprises:

a casing:

male and female rotors rotating in mesh with each other around two parallel axes, respectively, in said casing so that a gas that is sucked from a suction opening is introduced through a suction port into a groove space defined between said male and female rotors and said casing and then discharged from a discharge operating through a discharge port, wherein a fixed throttle plate is provided upstream and near the opening of said suction port.

2. A screw vacuum pump as defined in claim 1, wherein said fixed throttle plate comprises a projecting part of said casing.

3. A screw vacuum pump as defined in claim 1, wherein said throttle plate comprises a member separate from said casing and is attached to said casing when said pump is assembled.

4. A screw vacuum pump as defined in claim 1, which comprises a suction connection pipe wherein said suction opening extends in an axial direction of said casing, and wherein said throttle plate extends from said suction connecting pipe and is united with said suction connecting pipe by a throttle plate support.

5. A screw vacuum pump as defined in any one of claims 1 through 4, wherein said pump has a two-stage structure comprising a pre-stage pump and a post-stage pump, and wherein said pre-stage pump has said throttle plate.

* * * * *